US006821198B2

(12) United States Patent
Abe et al.

(10) Patent No.: US 6,821,198 B2
(45) Date of Patent: Nov. 23, 2004

(54) DISC GUIDING DEVICE FOR DIRECTING DISCS DISCHARGED FROM A DISC PASSAGEWAY

(75) Inventors: Hiroshi Abe, Iwatsuki (JP); Yasuo Irie, Iwatsuki (JP)

(73) Assignee: Asahi Seiko Co., Ltd., Tokyo (JP)

( * ) Notice: Subject to any disclaimer, the term of this patent is extended or adjusted under 35 U.S.C. 154(b) by 208 days.

(21) Appl. No.: 10/166,894

(22) Filed: Jun. 11, 2002

(65) Prior Publication Data

US 2002/0193062 A1 Dec. 19, 2002

(30) Foreign Application Priority Data

Jun. 15, 2001 (JP) ..... 2001-182079
Jun. 15, 2001 (JP) ..... 2001-182322

(51) Int. Cl.[7] ..... G07D 1/00
(52) U.S. Cl. ..... 453/45; 453/32
(58) Field of Search ..... 453/18, 19, 20, 453/21, 24, 25, 29, 30, 32, 36, 37, 39, 43, 44, 45, 50, 51, 52

(56) References Cited

U.S. PATENT DOCUMENTS

| | | | | |
|---|---|---|---|---|
| 4,592,377 A | | 6/1986 | Paulsen et al. | 133/5 R |
| 5,112,060 A | | 5/1992 | Jones | 273/309 |
| 5,386,903 A | | 2/1995 | Rothschild et al. | 194/350 |
| 5,512,016 A | | 4/1996 | Tani | 453/32 |
| 5,558,197 A | | 9/1996 | Rothschild et al. | 194/344 |
| 5,662,520 A | | 9/1997 | Evdokimo | 453/3 |
| 5,810,655 A | * | 9/1998 | Suzukawa et al. | 453/50 |
| 5,876,275 A | | 3/1999 | Rasmussen | 453/32 |
| 5,931,732 A | * | 8/1999 | Abe et al. | 453/50 |
| 2002/0013127 A1 | * | 1/2002 | Abe et al. | 453/18 |
| 2002/0072319 A1 | * | 6/2002 | Abe | 453/49 |
| 2003/0148728 A1 | * | 8/2003 | Abe et al. | 453/52 |

FOREIGN PATENT DOCUMENTS

| | | | | |
|---|---|---|---|---|
| EP | 0.312.316 A2 | * | 4/1989 | G07D/1/00 |
| JP | 5-73749 A | * | 3/1993 | G07D/1/00 |
| JP | 09-305817 | | 11/1997 | G07D/1/00 |
| JP | 10-049725 | | 2/1998 | G07D/9/00 |

* cited by examiner

*Primary Examiner*—Donald P. Walsh
*Assistant Examiner*—Mark J. Beauchaine

(57) ABSTRACT

A device guiding disc to direct discs to a desired location includes a guiding passageway for guiding and aligning the individual discs at an exit position. A pushing device can contact the discs at the exit position and move the disc out of the guiding passageway. A roller member can be positioned adjacent the bottom of the exit position to support and translate the disc as it is pushed by the pushing device. A support device, such as a tapered roller member, can be positioned above the exit position to receive an upper edge of the disc and to operatively position the disc for subsequent contact with the pushing device wherein the disc is positioned at an inclined angle to a longitudinal axis of the guiding passageway.

26 Claims, 11 Drawing Sheets

DISC GUIDING DEVICE FOR DIRECTING DISCS DISCHARGED FROM A DISC PASSAGEWAY

BACKGROUND OF THE INVENTION

1. Field of the Invention

The present invention is directed to the bulk storage and distribution of discs from a hopper assembly and more particularly to the selective distribution of discs that are sequentially guided to an exit opening for a speedy discharge to a desired direction.

2. Description of Related Art

Disc delivery apparatuses for delivering monetary coins, medallions, tokens, or the like, for use in a money exchanger, a coin dispenser, a ticket vending machine, an arcade game, a gambling game machine, or the like, are known in the art. Bulk discs are generally stored within a hopper and selectively discharged in accordance with a controller to a user. The coin dispensing industry has attempted to increase the speed and anti-jamming features of such coin dispensers. Frequently, it is desirable to not only select and dispense a disc or a coin, but to further divert the disc to different locations. For example, a supplemental lock box can be provided to divert excess coins to a storage device when they are not needed for dispensing to the user. A slot machine in the gaming industry may accept quarters from a player during the play of the slot machine and can also dispense the quarters as a jackpot if the user aligns a winning combination of images. If the deposited coins exceed the desired reserve of bulk coins necessary for a jackpot, it can be desirable to divert some of the coins to an auxiliary lock box within the gaming machine for storage.

Thus, the prior art has proposed various devices to not only accelerate the dispensing of the coins or discs from an exiting disc passageway, but has also proposed guiding the dispensed coins in different directions. An example of such a device can be found in the Japanese Laid Open Publication No. 10-49725 and Laid Open Publication No. 9-305817. These references disclose a storage hopper for coins having an elevated coin passageway wherein coins can be delivered from a rotating selector in the storage hopper to be elevated to a discharge device that can selectively discharge individual coins in one of two passageways or directions.

The prior art is seeking to increase the speed of dispensing such coins, while eliminating the possibility of jammed coins at such discharge devices.

SUMMARY OF THE INVENTION

The present invention provides a disc guiding device that is capable of directing discs to a desired location. The disc guiding device can be installed as original equipment on, for example, a coin discharging apparatus, or can be retrofitted to such equipment. The disc guiding device can be attached to a coin passageway that has coins or discs being guided from a bulk storage hopper. The disc guiding device connects its guiding passageway to the passageway from the coin hopper to guide and align individual discs in an exit position on the guiding passageway. A pushing device can contact a disc located at the exit position, and can move the disc out of the guiding passageway. An adjacent diverter unit with diverting passageways can receive the disc and direct it to the desired location. A supporting device, such as a conical roller, can be positioned traverse to the exit position to initially receive an upper edge of a disc to align the disc in an operative position for subsequent contact with the pushing device wherein the disc is positioned at an inclined angle to a longitudinal axis of the guiding passageway. The pushing device can have a cam surface and be spring biased to cause a pair of rollers to contact a lower surface of the disc and eject it from the exit position. The conical roller can be further spring biased to initially contact an upper edge of the disc as it is translating along the guiding passageway and to partially move upward with the disc until it is properly aligned in an inclined position in the exit position of the guiding passageway. The cam surface of the pushing device can move the lower edge of the disc onto a rotatable roller positioned adjacent the lower surface of the exit position whereby the disc is released into the diverting passageway. The diverting passageway can have an inverted V shape with a roller positioned at the apex of the lower surface of the V shape to further reduce friction during the release of the disc. The diverter unit can further have a roller mounted on a movable lever that can be controlled by a motive device, such as a solenoid, to block one of two directions in the diverter passageway for direction of the disc to the desired location. The above combination of features and sub-combination of features permit a high speed, low friction, discharging of discs to desired directions.

DETAILED DESCRIPTION OF THE PREFERRED EMBODIMENTS

The following description is provided to enable any person skilled in the art to make and use the invention and sets forth the best modes contemplated by the inventors of carrying out their invention.

The present invention discloses a guiding and diverting device for directing discs to a desired location. The terminology "disc" has been utilized in the present specification to describe thin cylindrical components and is generically descriptive of both monetary coins, medallions, tokens, or other devices which are stored in bulk and individually dispensed, such as coin dispensers.

The present invention has recognized that the dispensing speed at the exit of prior art diversion devices has been generally at a lower velocity than the speed at which the coins are capable of being moved along passageways to such an exit location. A limitation has existed on the possible disc speed at such a position in a coin dispenser, since the disc is being redirected from one direction to another direction and must be accelerated in the new direction. Increases in speed in the passageway can cause jamming at such guiding and diverting devices. The present invention addresses these problems by an innovative reduction in resistance to the movement of the discs and providing structure to increase the dispensing speed of the discs, while aligning the discs in an operative position to positively be discharged from an exit position into a diverting passageway.

The present invention also liberally utilizes rollers for both supporting the disc and pushing the disc from the exit passageway to the diverting passageway. A conical roller can move with the upper edge of a disc while exerting a spring biased force to urge the disc to an inclined position to bridge between the guiding passageway and the diverting passageway. Rollers on a pushing member can urge the disc to translate across a supporting roller for alignment within the diverting passageway. A roller mounted in the diverting passageway can receive the lower edge of the disc to lower the friction as the disc is directed by another roller in the diverting passageway towards a preferred location. The liberal use of rollers further eliminates frictional resistance to the acceleration and redirection of the exiting disc. As a result of this arrangement, a consistent position is created for each of the succeeding discs at the exit opening from the guiding passageway, so that minimum friction is applied to the discs and the discs will not jam.

Figure 1:
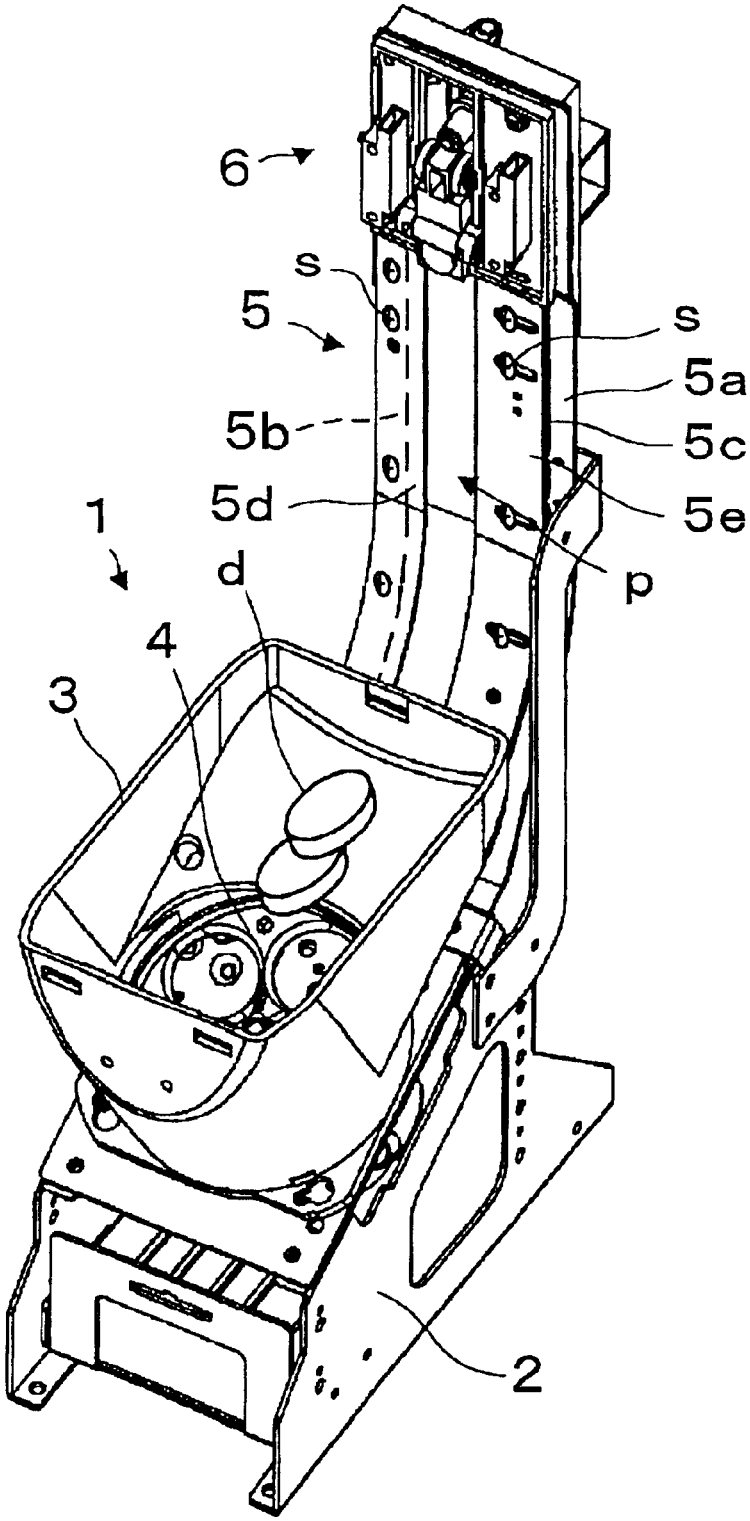
FIG. 1 is a perspective view of a coin hopper with a disc guiding device installed at the top of a coin escalator passageway.

Referring to FIG. 1, a coin dispensing apparatus 1 having a hopper bowl 3 is mounted on a supporting frame 2. The hopper bowl 3 is cylindrical in shape and includes a selecting rotating disc 4, as known in the art. Bulk coins or discs d are stored in the hopper bowl 3 and rotation of the selector rotating disc 4 can align and selectively remove individual discs for dispensing from the hopper bowl 3. An example of such a hopper bowl 3 can be found in the Japanese Laid Open Patent Application No. Hei 6-150102.

An escalator 5 is affixed to and extends upward from the frame 2. The escalator 5 includes a base 5*a* which is rectangular in shape and extends in an upward vertical direction. A pair of spacers 5*b* and 5*c*, which are also rectangular in shape extend in the vertical direction and are slightly thicker than the dimensions of the disc d. A pair of supporting plates 5*d* and 5*e* have contact with the spacers 5*b* and 5*c*. The spacers are also slightly larger than the diameter of the disc d. The distance between the supporting plate 5*d* and 5*e* is smaller than the distance between the spacers 5*b* and 5*c*. The respective supporting plates and spacers are affixed at the base 5*a* by a screw s. As can be appreciated, if different denominations of coins are utilized, it is possible to adjust the coin passageway in the escalator. The escalator has a guide passageway p which is rectangular and cross-sectional shaped and extends upward in a vertical direction along a longitudinal axis.

At the top of the escalator 5, a disc guiding and diverting device of the present invention is operatively attached.

Figure 5:
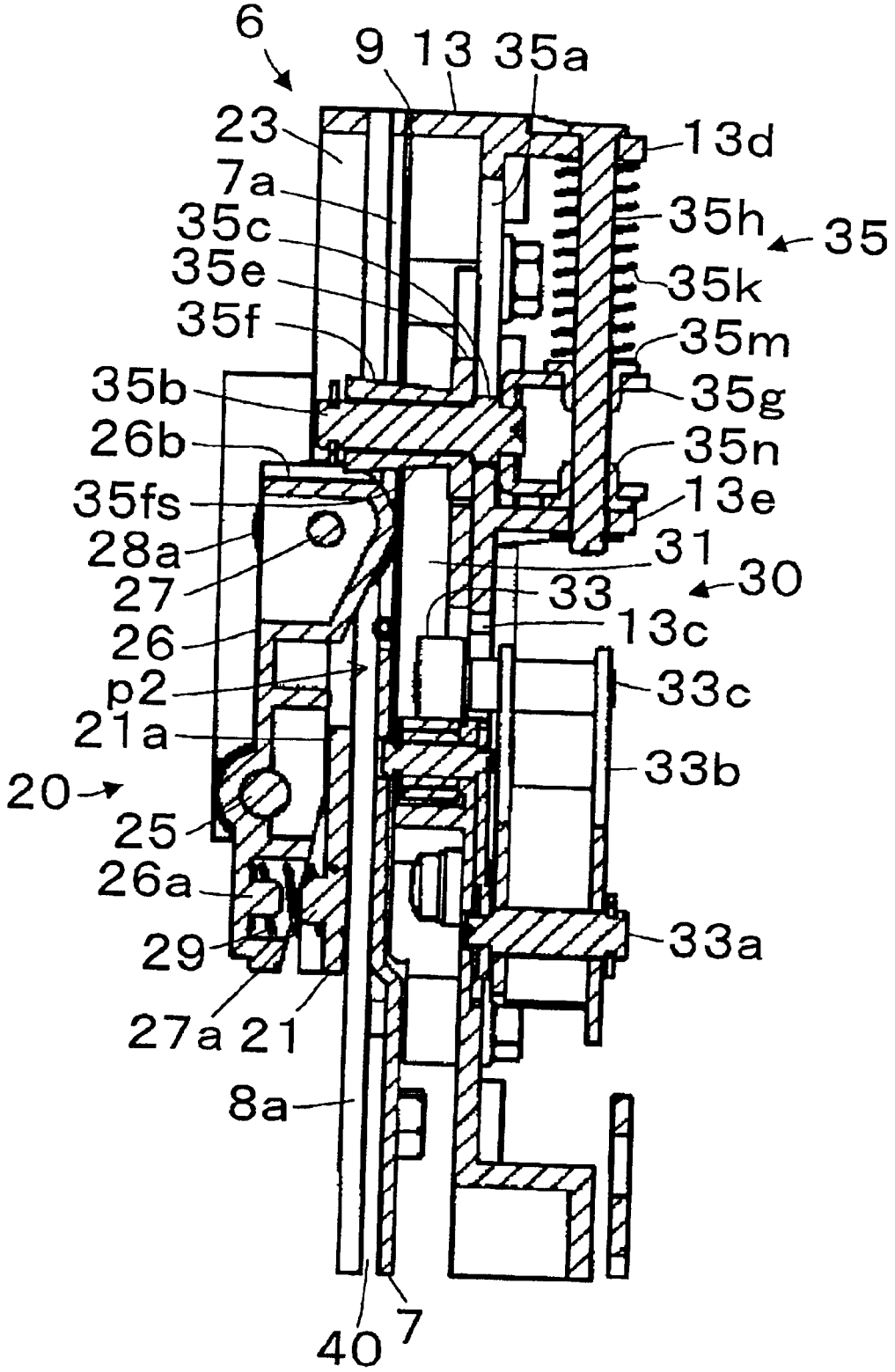
FIG. 5 is a cross-sectional view taken along the line y—y of FIG. 3.
Figure 6:
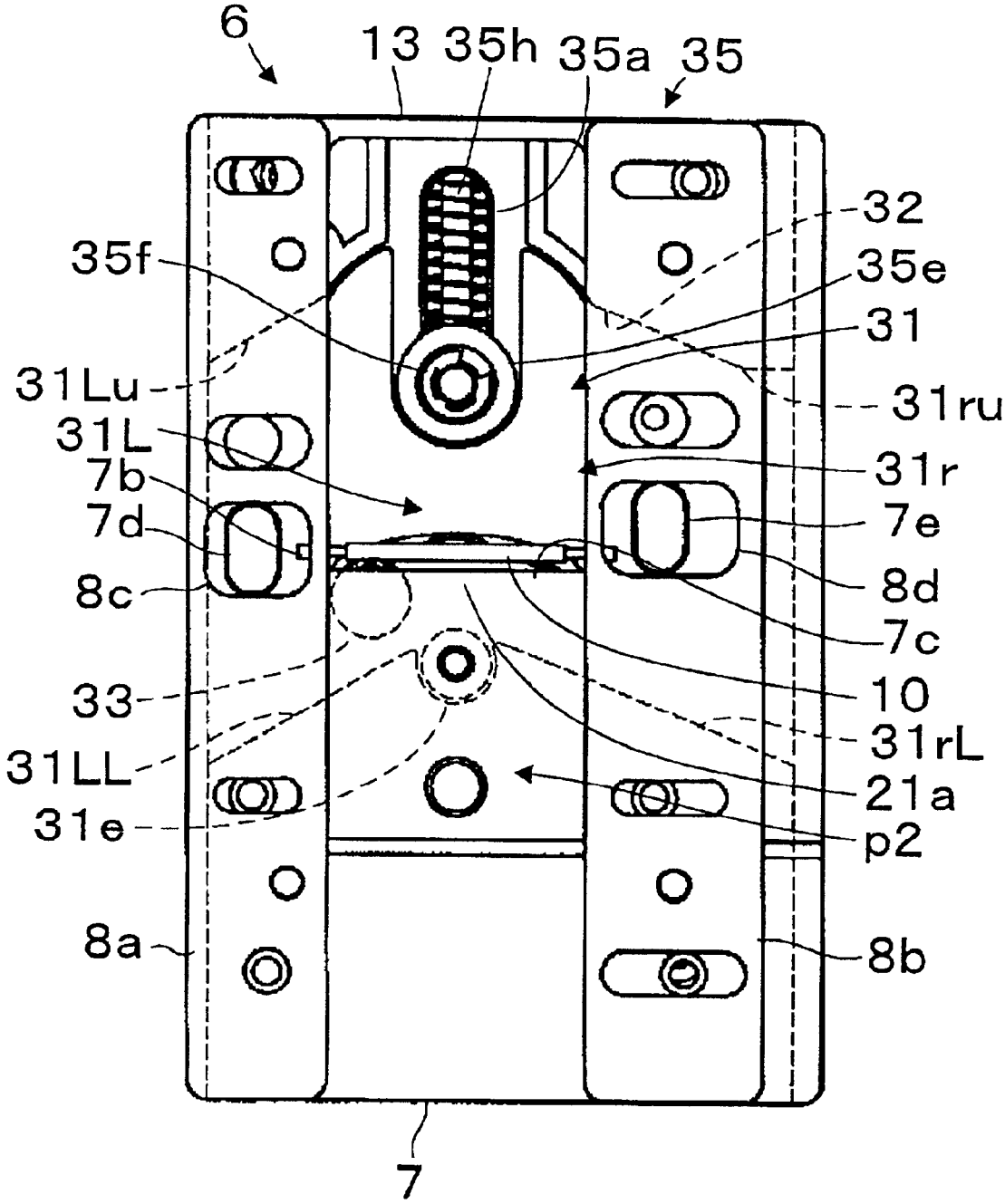
FIG. 6 is an elevational view of FIG. 2 with a guide plate removed.
Figure 7:
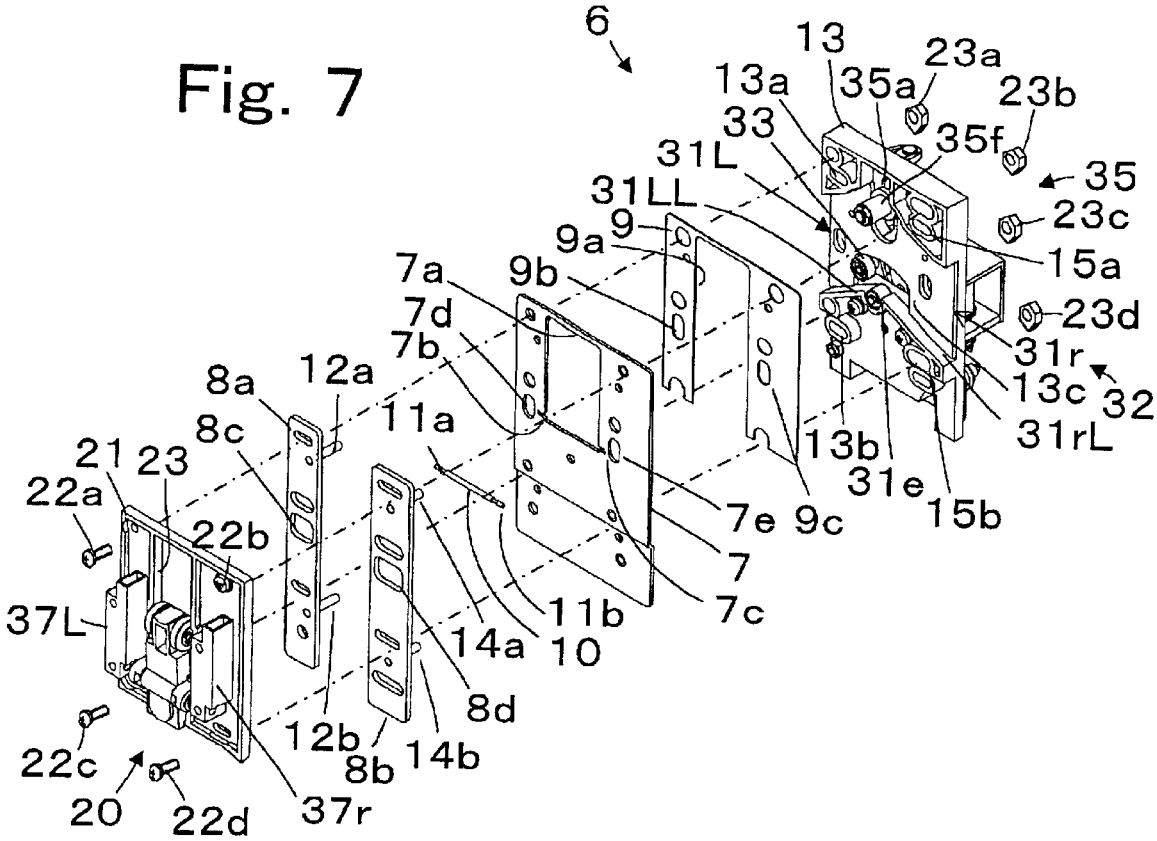
FIG. 7 is a an exploded perspective view of the disc guiding device of FIG. 2.
Figure 8:
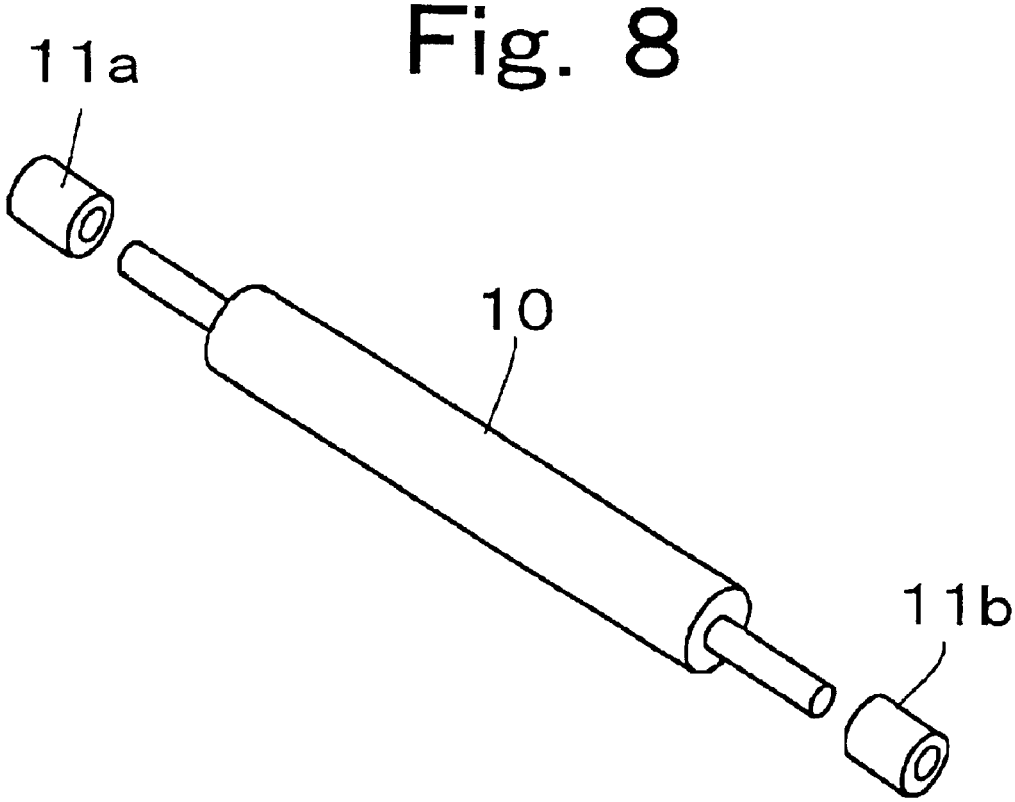
FIG. 8 is a perspective view of a roller member for supporting a lower edge of a disc.

Reference can be made to the views in FIGS. 2–7 and the following explanation of the diverting device or disc guiding device of the present invention. The exploded view of the disc guiding device 6, as shown in FIG. 7, shows a base plate 7 rectangular in shape with a lower section offset or crank-like in shape. A rectangular opening 7*a* is formed at the center of the upper section. At the bottom of a lower section of opening 7*a* are a pair of holding grooves 7*b* and 7*c*. These holding grooves extend sideways on both sides of the lower section of the opening 7*a*, and are designed to receive bushings 11*a* and 11*b* for supporting a small roller 10, as shown in FIG. 8. The diameter of the roller 10 can be of approximately the same thickness as the base plate 7, or can even be smaller than the thickness of the base plate 7. Preferably, the roller 10 is made from metal in order to increase its strength and endurance. Alternatively, other materials can be utilized if desired. The roller 10 can be further coated with a surface treatment to increase its durability. A second guiding passageway p2 will be defined through the disc guiding device 6 between the spacers 8*a* and 8*b* to deliver a disc or coin to the opening 7*a*. Parallel to the longitudinal axis of this guiding passageway is a diverting passageway 31 of an inverted V-shape having a left passageway 31L and a right passageway 31*r*.

The roller 10 will be located between the guiding passageway and the diverting passageway 31 so that a disc d will have a minimal frictional contact with the roller 10 as it is translated from the guiding passageway to the diverting passageway.

As shown in FIG. 6, the roller 10 can be located in the middle of the second guiding passageway p2 to extend at a traverse right angle. When the roller 10 is appropriately inserted into the bushings 11*a* and 11*b*, the relative rotating friction of the roller will be very small.

A spacer 9, which is gate-like in shape, is attached to the back side of a base plate 7. The bushings 11*a* and 11*b* are supported in the supporting grooves 7*a* and 7*b* by the spacer 9. An elongated vertical groove 9*a* is located parallel to the opening 7*a*.

Spacers 8*a* and 8*b* are pressed to the opposite side of spacer 9 on the base plate 7. The bushings 11*a* and 11*b* are further supported in the supporting grooves 7*b* and 7*c* by the spacers 8*a* and 8*b*. The spacers 8*a* and 8*b* are rectangular plates and can be provided with positioning pins 12*a* and 12*b*, which are fixed at the back side of spacer 8*a* and positioning pins 14*a* and 14*b*, which are fixed at the back side of spacer 8*b*. These pins penetrate the base plate 7 and spacer 9 and are inserted into lateral elongated holes 13*a* and 13*b* and 15*a* and 15*b*, respectively. The set distance of the spacers 8*a* and 8*b* are slightly larger than the desired diameter of the disc d that is to be discharged. If there is a change in the disc d diameter, a new base plate 7 can be changed and the distance between the spacers 8*a* and 8*b* can also be changed to accommodate the new dimensional disc.

A series of screws 22*a*, 22*b*, 22*c*, and 22*d* extend through holes at each of the four corners of the supporting plate 21. The respective spacers 8*a* and 8*b*, base plate 7, spacer 9, and fixing base 13 are fixed between the screws, which are in turn threaded into nuts 23*a*, 23*b*, 23*c*, and 23*d*. The positioning of the spacers 8*a* and 8*d* are located so that they extend through the passageway of the spacers 5*b* and 5*c* of the escalator 5.

The second guiding passageway p2 extends in the vertical direction, as defined by the base plate 7, spacers 8*a* and 8*b*, and the supporting plate 21 and is a continuation of the escalator guiding passageway. With this arrangement, the discs that are being selectively discharged from the hopper bowl can be sequentially passed from the escalator 5 into the guiding passageway of the disc guiding device and delivered to an exit opening in the guiding passageway.

Figure 4:
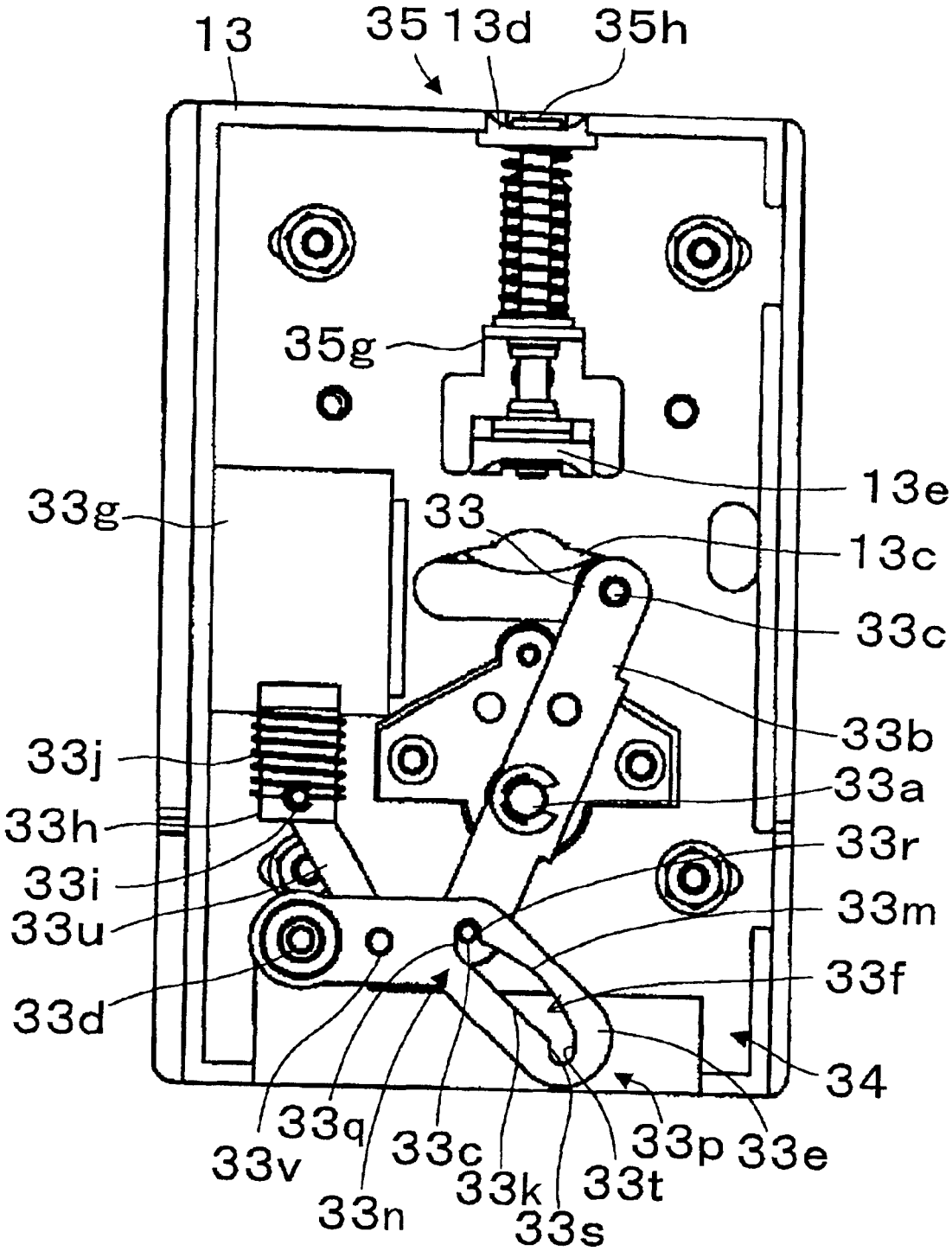
FIG. 4 is a rear elevational view of FIG. 2.

A pushing device for contacting the disc at an exit position and moving the disc out of the guiding passageway can be understood by reference to FIGS. 2, 3, 4, and 5. An elongated hole 23 extends in the central vertical direction at the middle of the supporting plate 21. Bearings 24*a* and 25*b* are located on both sides of the elongated hole 23. One end of a shaft 25 is supported by the bearings 24*a* and 24*b*, as seen in FIG. 5. A lever 26 pivots about the shaft 25 and can be biased by a compression spring 29 mounted about a projection 27*a* on the supporting plate 21. The spring is also mounted on a projection 26*a* located at the lower section of the lever 26. As shown in FIG. 5, the spring biases the lever 26 to extend within the longitudinal axis of the guiding passageway p2. Thus, the lever 26 is biased to pivot in a clockwise direction as shown in FIG. 5, and its rotation is stopped by the end section 21*a* of the supporting plate 21. A pair of rollers 28*a* and 29*b* are mounted on the lever 26 by a shaft 27. The surface of the rollers 28*a* and 29*b* can pass through the opening 7*a* of base plate 7 and the vertical elongated groove 9*a* of spacer 9 to extend over into the diverting passageway 31.

As a modification of this embodiment, the rollers 28*a* and 29*b*, which can form cam surfaces for contacting a disc, could be removed so that the cam surface at the end of the lever 26 can be utilized for contacting the side surface of a disc.

Figure 10:
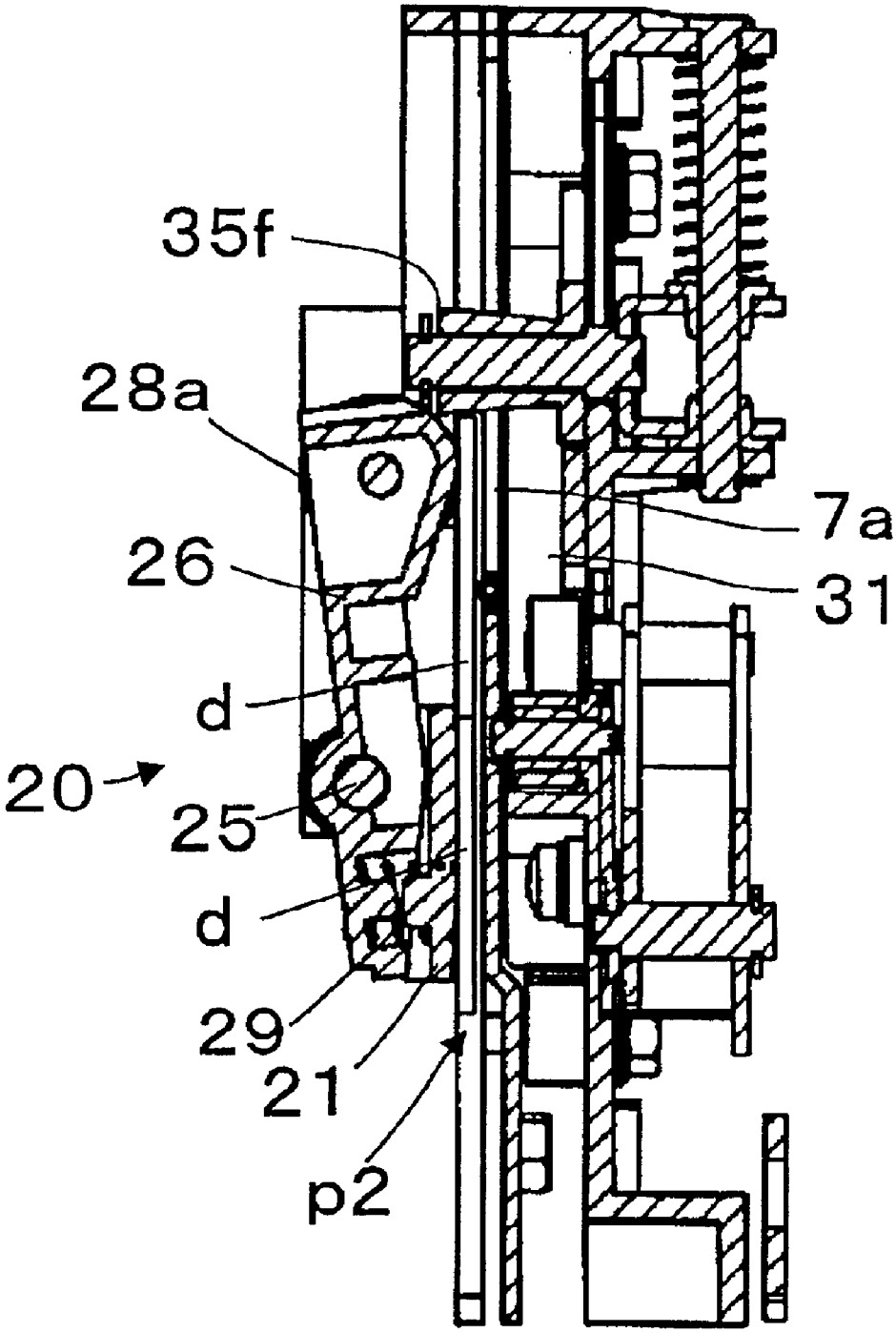
FIG. 10 is a cross-sectional view of FIG. 3 for explanation purposes.
Figure 11:
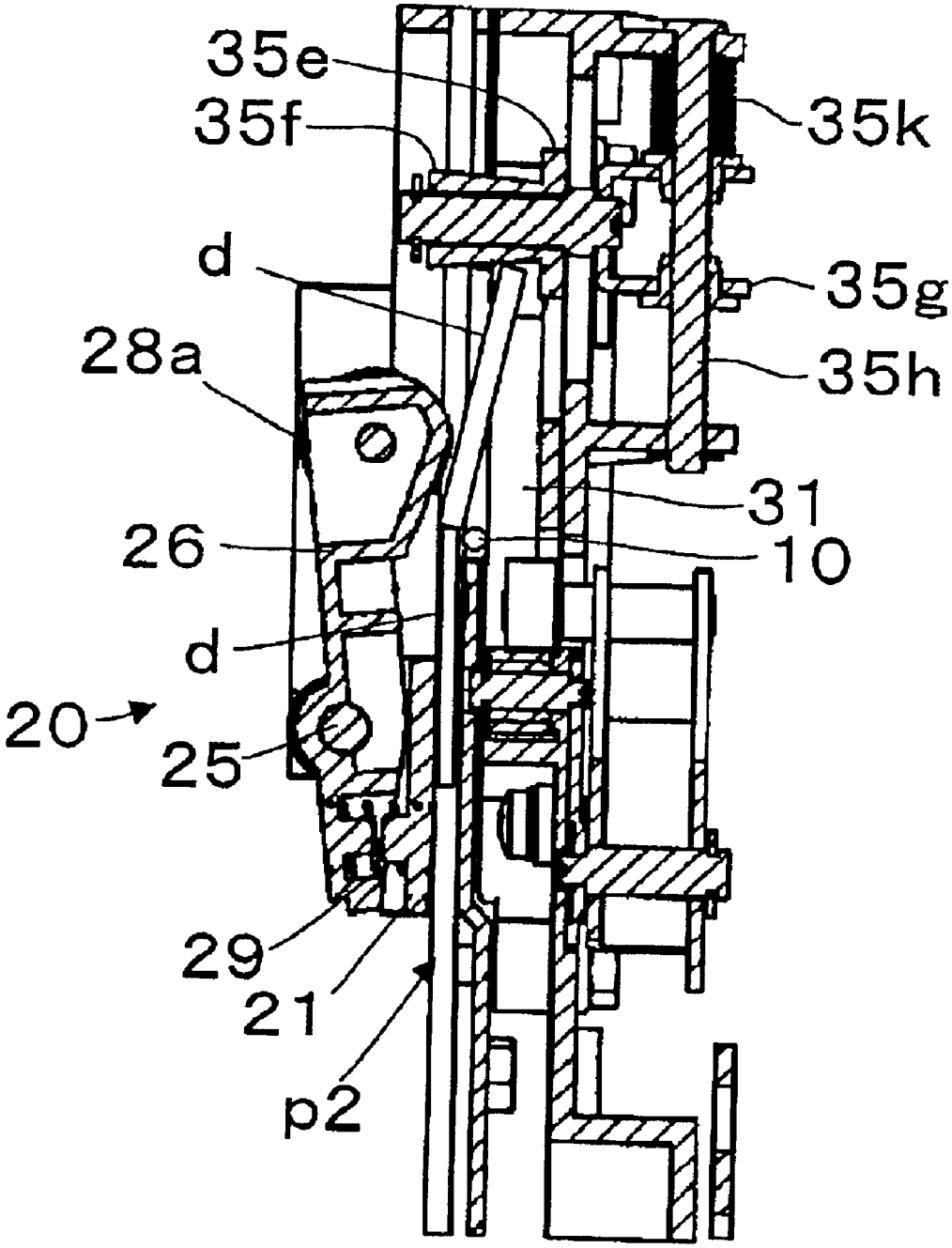
FIG. 11 is a cross-sectional view of FIG. 3 for explanation purposes.

Referring to FIG. 10, a series of discs d have translated vertically upward in the guiding passageway p2 and have forced the lever 26 to the left so that the upper discs can contact a conical roller 35*f*. As seen in FIG. 11, the upper edge of the lever 26 will be at the lower side surface of the disc 9 for exerting a force to direct the disc d out of the guide passageway p2.

A diverting device 30, as shown in FIGS. 5, 6, and 7 can include a diverting passageway 31, a diverter 33, and an accelerating device 35. The diverting passageway 31, as shown in FIG. 6, is parallel to and offset from the guiding passageway p2. The diverting passageway 31 has a left slanting supporting surface 31LL, which slants downward towards the left on the fixing base 13. A right slanting support surface 31*r*L slants downward towards the right and is also located on the fixing base 13. Upper supporting slanting surfaces 31Lu and 31*ru* are located above the slanting surfaces 31LL and 31RL. The resulting structure provides a diverting groove 32, which has an inverted v-like shape and is located on the side of the spacer 9, the fixing base 13, and the slanting surfaces 31LL and 31RL. The lower end of the diverting groove 32 is made up of the left slanting surface 31LL and right slanting surface 31RL. At the apex of these two slanting surfaces, a roller 31*e* is mounted to reduce friction. The fixing base 13 can be fixed to the spacer 9 will cover the side of the left and right slanting surfaces 31LL and 31RL and the space between the respective slanting surfaces. Thus, the diverting passageway 31 includes the right passageway 31R and the left passageway 31L.

The lower end of the opening 7*a* is located above the roller 31*e*. Accordingly, the upper edge of the roller 10, which is substantially along the lower edge of the opening 7*a*, is also located above the roller 31*e*.

When a disc is released from the guide passageway p2, it can travel either to the right or the left in the diverting passageway. A diverter unit 33, however, is employed to select the desired passageway for the release of the disc. The diverter 33 is a roller which can be selectively positioned to block one of the two directions of the diverting passageway 31. The diverter unit 33 includes the roller that passes through the opening 13*c*, which is located in the middle of the fixing base 13 at the diverting passageway 31.

As shown in FIG. 5, the diverter roller 33 has contact with the surface of the fixing base 13 and the distance between the diverter roller 33 and the spacer 9 is nearly the same thickness as a disc. The upper surface of the diverter roller 33 is located above the upper surface of the roller 10.

A moving device 34 for selectively moving the diverter roller 33 can be explained with reference to FIG. 4. The diverter roller 33 is rotatably mounted on a shaft 37*c*, which is fixed to the end of lever 33*b*. Lever 33*b* pivots on a fixed shaft 33*a*, which in turn is fixed on the fixing base 13. A pin 33*r* is located at the lower section of 33*b* and can act as a follower for insertion into a cam groove 33*f* that has an s-like shape. The pin 33*r* is located at the lever 33*e*, which pivots on the fixed shaft 33*d* that is, in turn, fixed to the fixing base 13.

A solenoid 33*g* with a plunger or core 33*h* is operatively linked to the middle of the lever 33*e* through the pin 33*i*, link 33*u*, and pin 33*v*. The core 33*h* is biased downward by a spring 33*j*.

The cam groove 33*f* is an elongated hole which is obtuse to the extending direction of the lever 33*e*. A first edge 33*k* of cam groove 33*f* has a straight-like configuration, while a second edge 33*m*, which is opposite to the first edge 33*k*, has an arc-like shape. Both edges of the cam groove 33*f* have stoppers 33*n* and 33*p*. Stopper 33*n* has stopping surfaces 33*q* and 33*r*, which are straight, while stopper 33*p* has stopping surfaces 33*s* and 33*t*, which are straight.

When the pin 33*c* is located in the stopping groove 33*n*, the diverting roller 33 will be located at the left passageway 31L, as shown in FIG. 4. This blocks the left passageway and causes a dispensed disc to travel down the right passageway 33*r*.

Figure 9:
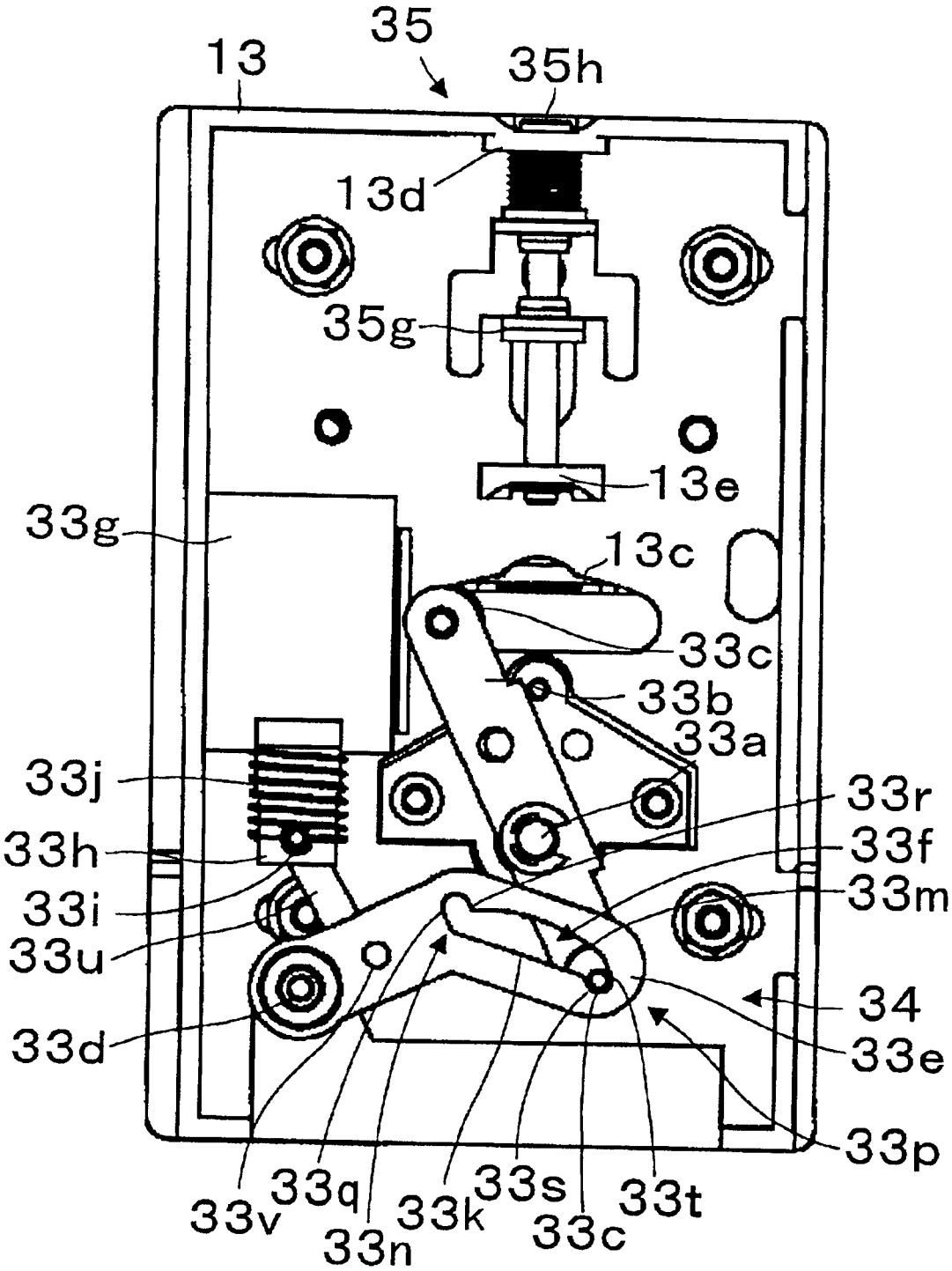
FIG. 9 is a rear elevational view for purposes of explanation.

Because pin 33*c* pivots on fixed shaft 33*a*, it will move to the left and to the right, and it cannot move towards a right angle to the stopping surfaces 33*q* and 33*r*. When pin 33*c* is located in the stopping groove 33*p*, the diverter roller 33 will be located at the right passageway 31*r*, as shown in FIG. 9. Again, because pin 33*c* pivots on the fixed shaft 33*a*, it moves to the left and to the right and it cannot move towards a right angle to the stopping surfaces 33*s* and 33*t*.

When the solenoid 33*g* is activated and the pin 33*c* is located at the stopper 33*n*, then the lever 33*e* will pivot in the counter-clockwise direction, as shown in FIG. 4. Pin 33*c* is pushed by the first edge 33*k* until it reaches the stopper 33*p*. As a result, lever 33*b* will pivot in the counter-clockwise direction, as shown in FIG. 9, and then diverter roller 33 will be located to effectively block the right passageway 32*r*.

When the solenoid 33*g* is not energized, then the force of the spring 33*j* will cause the lever 33*e* to pivot in the clockwise direction. As a result of this pivoting motion, the pin 33*c* is pushed by the second edge 33*m* until it reaches the stopper 33*n*. As a result, lever 33*b* will pivot in the clockwise direction and the diverter roller 33 will be moved to be located in the left passageway 32L.

As can be seen in FIG. 4, an accelerator device 35 is positioned above the diverting passageway for exerting a force in expelling a disc. A guiding hole 35*a*, which can be seen in FIGS. 5–7, extends in a vertical direction above the diverting passageway. The hole 35*a* is elongated and parallel to the opening 7*a* and is located in the fixing base 13. A sliding shaft 35*b* extends through the guiding hole 35*a* and has a large diameter section 35*c*, which is guided within the guiding hole 35*a* so that it can move up and down. A roller 35*f* is mounted on the sliding shaft 35*b*. The roller 35*f* has a flange 35*e* which is also rotatable and assists in reinforcing the structure of the roller 35*f*. As an alternative embodiment, a contact plate can be mounted for sliding movement. The arrangement of the roller 35*f* however is preferred because it assists in reducing the friction in contact with the upper edge of a disc. Roller 35*f* is located above the roller 31*e* and extends over the diverting passageway 31, vertical elongated groove 9*a*, opening 7*a*, and elongated hole 23. It is desirable for the roller 33*f* to have a tapered or conical configuration so that the diameter becomes smaller as it extends towards the opening 7*a* in the diverting passageway 31. A spring 35*k* is mounted around a guiding shaft 35*h*. A guide member 35*g* supports a pair of bushings 35*m* and 35*n*, which are journaled on the guiding shaft 35*h* so that the guide 35*g* can be slideable along the length of the guiding shaft 35*h*. The guide member 35*g* supports one end of the roller 35*f*.

When the roller 35*f* is located at its lower limit position, shown in FIG. 5, the lower surface of the roller 35*f* is located slightly below the upper surface of the rollers 28*a* and 28*b* on the pushing device 20. A clearance groove 26*b* is located at the top of the lever 26 of the roller 35*f* The guiding shaft 35*h* is further fixed on the brackets 35*d* and 13*e* that are projected from the back surface of an affixing base 13. In the lowest position of the roller 35*f*, the bushing 35*n* has contact with the bracket 13*e*. This lowest position is based upon the diameter of the smallest disc d, which is contemplated to being dispensed. In determining the lowest position of the roller f, it is desirable to have it away from the upper surface of the roller 10, and to be half the diameter of the disc d to be dispensed.

When a disc d contacts the roller 35*f*, it can compress the spring 35*k* and the tapered configuration of the roller 35*f* can cause the upper edge of the disc d to slide towards the flange 35*e*. Thus, the disc d will be located in an exit opening of the guiding passageway p2 inclined to the longitudinal axis of the passageway p2, as shown in FIG. 11. The rollers 28*a* and 28*b* can then push the lower section of the disc d below the center of the disc d, so that the lower edge of the disc d will contact the moveable roller 10 and be translated from the guiding passageway p2 into the diverting passageway 31. Because the disc d is pushed across the surface of the roller 10, its movement will be efficient and smooth, and it will be released so that the disc d will fall down to be released along one direction of the diverting passageway.

Figure 2:
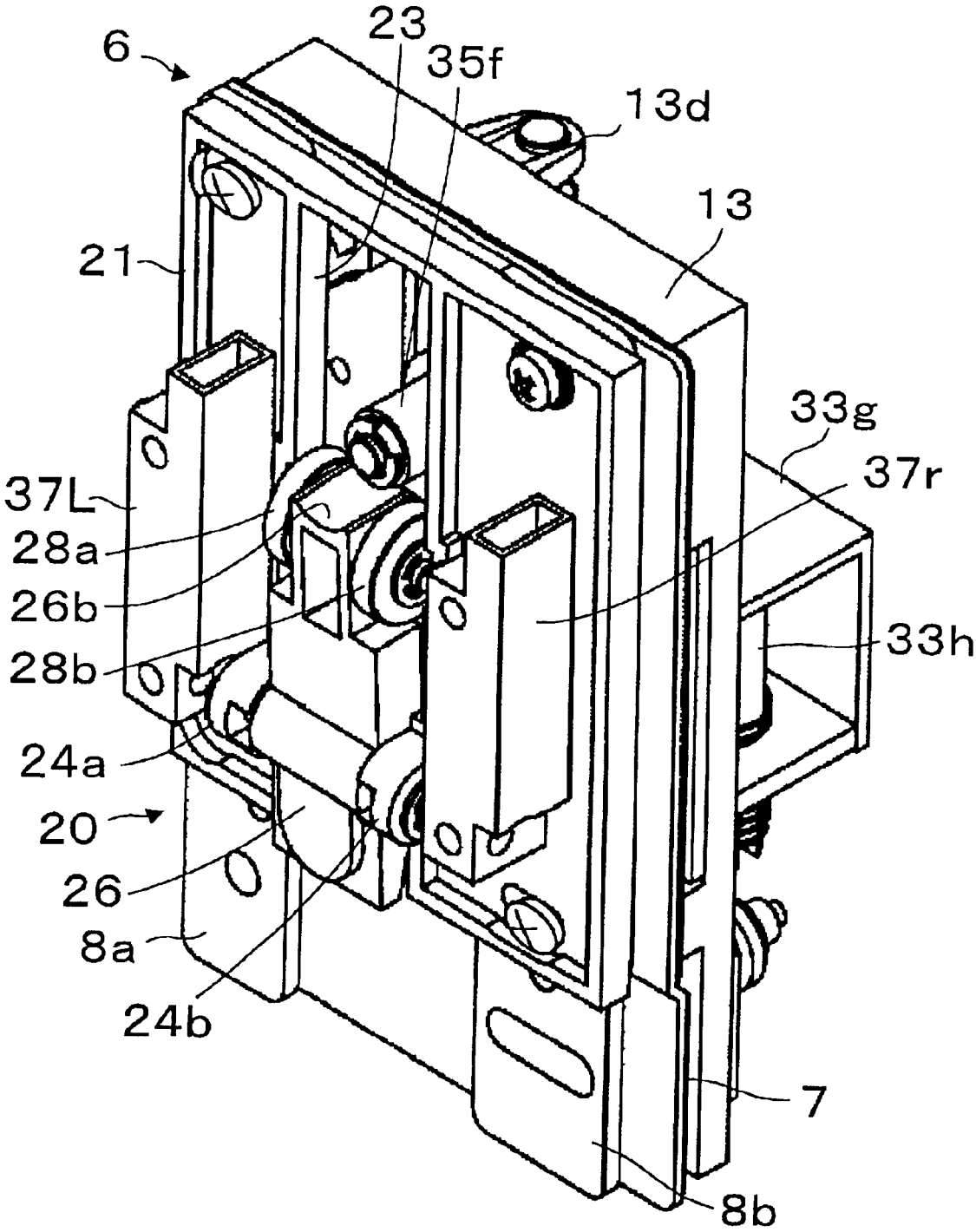
FIG. 2 is a perspective view of a disc guiding device and diverter of the present invention.
Figure 3:
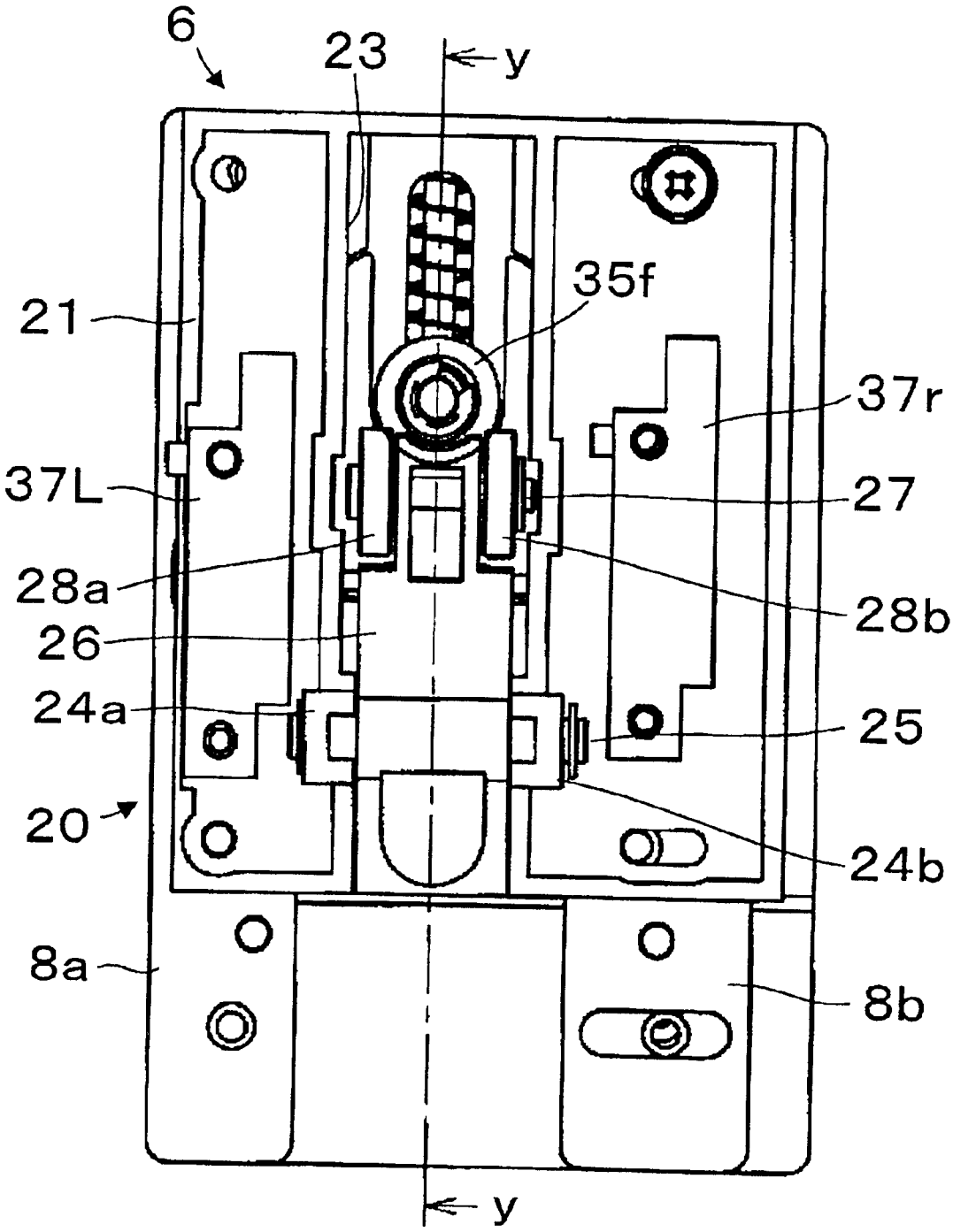
FIG. 3 is a front elevational view of FIG. 2.

Referring to FIG. 2, the support plate 21 also supports a left photosensor unit 37L and a right photosensor unit 37R. As shown in FIG. 7, hole 8*c* is located at spacer 8*a*, hole 7*d* of base plate 7 and hole 9*b* of spacer 9 are aligned face to face with a light-transmitting section and a receptive section of the left photosensor 37L. Light is reflected off a disc 7 will be received by the respective photosensors as they monitor the respective right divergent passageway 31R and the left divergent passageway 31L Each of the respective photosensors can output a detecting signal to count the number of discs d which are translated through the respective diverging passageways. Also, as shown in FIG. 7, hole 8*d* is located at spacer 8*b*, hole 7*a* on the base plate 7, and hole 9*c* of the spacer 9 are aligned with the light-transmitting section and the light-receptive section of the right photosensor 37*r*.

The diverting device or disc guiding device 6 of the present invention is fixed at the top of the escalator 5. The top of base 5 is inserted into a slit 40, which consists of a base plate 7 and spacers 8*a* and 8*b*, which are in turn fixed by screws. The position of the affixing base 13 can be adjusted towards the lateral direction through the range of the laterally elongated holes 13*a*, 13*b*, 15*a*, and 15*b* so that the roller 35*b* can be located in the second guiding passageway p2. If the diameter of a disc is changed, e.g., a different monetary coin is utilized, the base plate 7 can be changed to a suitable size and the distance between the spacers 8*a* and 8*b* can also be changed.

Referring to FIG. 6, the operation of the preferred embodiment is disclosed. In FIG. 6, the diverted roller 33 is located in the left diverting passageway 31L. The solenoid 33*d* has not been energized and the core 33 is pulled down, as a result, the lever 33*e* has been pivoted in the clockwise direction.

As discs are released from the hopper bowl 33 through the rotation of the rotating disc 4, the discs d are sequentially lined up and vertically lifted within the guiding passageway p in the escalator 5. The discs arrive at the second guiding passageway p2 in the disc guiding device 6 and proceed vertically upward until the top-most disc d becomes abreast of the opening 7*a* in the second guiding passageway p2. At this point, the top half of the disc d contacts the rollers 28*a* and 28*b* and the lever 26 is pivoted in a counter-clockwise direction, against the biasing spring force, as shown in FIG. 10. The lower side of disc d is located between supporting plate 21 and base plate 7, and accordingly, disc d is still located within the second guiding passageway p2. As disc d is further pushed up, the top edge of disc d has contact with the roller 35*f* and it pushes up roller 35*f* against the push-down force of the spring 35*k*. During this process, the lower end of disc d is released from the supporting plate 21. Disc d is subject to a reactive force towards the side of the flange 35*e* as a result of the slanting surface of the roller 35*f* Disc d moves in a clockwise direction at a lower supporting point which is roller 10 by the reactive force of spring 35*k* and the pushing force of the rollers 28*a* and 28*b*. Disc d continues until it is stopped by the flange 35*e* of roller 35*f* In this position, as indicated by FIG. 11, disc d is slanting towards the right relative to the longitudinal axis of the guiding passageway p2.

When the bottom edge of disc d arrives at the upper surface of roller 10, rollers 28*a* and 28*b* push the lower section of disc d so that it is translated across the roller 10 and released into the diverting passageway 31. Since the roller 10 can rotate with the translation of the disc d, there is very little friction to oppose the forces exerted by the rollers 28*a* and 28*b*. When disc d is released from the support of the roller 10, it is pushed downwards by the roller 35*f* along the supporting plate 13.

During this release process or ejection process through the exit opening on the guiding passageway p2, disc d will come into contact with the diverter roller 33, as it is being pushed downwards by the roller 35*f*, as a result, disc d is pushed towards the right passageway 31*r*. Additionally, disc d will contact the friction roller 31*e* to further reduce friction on disc d. In this situation, the disc d will slide, as shown in FIG. 6. The friction encountered during the sliding movement will be very small, because the rollers 33 and 35*f* rotate. Disc d is further supported and guided by the roller 31*e*, the right slanting surface 31*ru*, and the slanting surface 31RL, as it is dispensed from the right passageway 31RL.

As disc d translates through the right passageway 31*r*, the right photosensor 37*r* detects disc d and outputs a detecting signal. A control device (not shown) can count the detecting signal. The ejection of disc d will continue until a counter determines a predetermined number, at that point, the rotating disc 4 contained within the hopper bowl 3 is stopped.

As a result of this arrangement of parts, the disc can be operatively ejected from the opening in the guide passageway p2 with a constant and controlled motion and the speed of the released disc can accommodate the speed of the disc extending up the escalator.

The operation of releasing a disc in the left passageway when the solenoid has been energized to move the diverter roller 33 operates in the same manner, as described above.

Those skilled in the art will appreciate that various adaptations and modifications of the just described preferred embodiments can be configured without department from the scope and spirit of the invention. Therefore, it is to be understood that, within the scope of the appended claims, the invention may be practiced other than as specifically described herein.

What is claimed is:

1. A disc guiding device for directing discs to a desired location comprising:

a guiding passageway for guiding and aligning individual discs to an exit position on the guiding passageway;

a pushing device for contacting the disc at the exit position and moving the disc out of the guiding passageway;

a roller member positioned adjacent the bottom of the exit position to receive a lower edge of the disc and to support and translate the disc as it is pushed by the pushing device; and a support device positioned above the roller member adjacent the exit position to initially receive an upper edge of the disc to align the disc in an operative position for subsequent contact with the pushing device wherein the disc is positioned at an inclined angle to a longitudinal axis of the guiding passageway.

2. The disc guiding device of claim 1 wherein the support device is spring biased and extends traverse to the longitudinal axis in the exit position to contact the disc and to initially travel upward with the disc for a predetermined distance.

3. The disc guiding device of claim 2, wherein the support device includes a conical roller for directing the upper edge of the disc to position the disc at an inclined angle with the longitudinal axis of the guiding passageway.

4. The disc guiding device of claim 1 wherein the pushing device includes a pair of rollers for contacting a side of the disc.

5. The disc guiding device of claim 4 wherein the pushing device is pivotally mounted and spring biased to extend into the exit position.

6. The disc guiding device of claim 5, wherein the pushing device has a cam contact face for contacting the disc.

7. The disc guiding device of claim 1 further including a diverter unit positioned adjacent the exit position to provide one of a first direction and a second direction for the disc when it exits the guiding passageway.

8. The disc guiding device of claim 7 wherein the diverter unit includes a movable roller for blocking one of the first and second directions.

9. The disc guiding device of claim 8 wherein the movable roller is rotatably mounted on a pivotally lever and a solenoid is operatively connected to the lever for positioning the movable roller to open one of the first and second directions for the disc.

10. A guiding device for directing discs, comprising:

a guiding passageway which guides and aligns the discs;

a diverting passageway which is positioned parallel and adjacent to the guiding passageway;

an opening in the guiding passageway which communicates with the diverting passageway;

a pushing device which pushes discs from the guiding passageway to the diverting passageway; and a roller located adjacent the opening for supporting and translating a disc from the guiding passageway to the diverting passageway.

11. A guiding device of claim 10 wherein the roller is located between the guiding passageway and the diverting passageway.

12. A guiding device of claim 10 wherein the roller is made from metal.

13. A guiding device of claim 10 wherein the roller is rotatable and is fixedly supported by bushings.

14. A guiding device of claim 10 further including a support device which can move along an extending direction of the guiding passageway and is located at the opening, the support device has a slanting surface which slants from the guiding passageway to the side of the adjacent diverting passageway.

15. A guiding device of claim 14 wherein the support device includes a roller.

16. A guiding device of claim 14 further comprising a roller support device for directing the disc towards the diverting passageway and a diverter roller for blocking one of two directions along the diverting passageway.

17. A guiding device of claim 14 further comprising a roller member which is located in the diverting passageway which is under the supporting device.

18. A disc guiding device for directing discs to a desired location comprising:

a guiding passageway for guiding and aligning individual discs to an exit position on the guiding passageway;

a pushing device for contacting the disc at the exit position and moving the disc out of the guiding passageway; and a diverter unit positioned outside of the exit position of the guiding passageway to provide one of a first direction and a second direction for the disc.

19. An ejecting device for ejecting discs, comprising:

a guiding passageway which guides and aligns the discs;

a diverting passageway which is positioned parallel and adjacent to the guiding passageway;

an opening in the guiding passageway which communicates with the diverting passageway;

a movable support device extending into the opening for contacting an upper edge of a disc to align the disc at an angle to a longitudinal axis of the guiding passageway wherein the support device includes a conical roller for directing the upper edge of the disc to position the disc at an inclined angle with the longitudinal axis of the guiding passageway; and a pushing device which pushes discs from the guiding passageway to the diverting passageway.

20. The ejecting device of claim 19 wherein the support device is spring biased and extends traverse to the longitudinal axis in the exit position to contact the disc and to initially travel upward with the disc for a predetermined distance.

21. The ejecting device of claim 19 further including a diverter unit positioned adjacent the exit position to provide one of a first direction and a second direction for the disc when it exits the guiding passageway.

22. The ejecting device of claim 21 wherein the diverter unit includes a movable roller for blocking one of the first and second directions.

23. The ejecting device of claim 22 wherein the movable roller is rotatably mounted on a pivotally lever and a solenoid is operatively connected to the lever for positioning the movable roller to open one of the first and second directions for the disc.

24. A disc guiding device for directing discs to a desired location comprising:

a guiding passageway for guiding and aligning individual discs to an exit position on the guiding passageway;

a pushing device for contacting the disc at the exit position and moving the disc out of the guiding passageway includes a pair of rollers for contacting a side of the disc; and a roller member positioned adjacent the bottom of the exit position to receive a lower edge of the disc and to support and translate the disc as it is pushed by the pushing device.

25. A disc guiding device for directing discs to a desired location comprising:

a guiding passageway for guiding and aligning individual discs to an exit position on the guiding passageway;

a pushing device for contacting the disc at the exit position and moving the disc out of the guiding passageway;

a roller member positioned adjacent the bottom of the exit position to receive a lower edge of the disc and to support and translate the disc as it is pushed by the pushing device; and a diverter unit positioned adjacent the exit position to provide one of a first direction and a second direction for the disc when it exits the guiding passageway.

26. A disc guiding device for directing discs to a desired location comprising:

a guiding passageway for guiding and aligning individual discs to an exit position on the guiding passageway;

a pushing device for contacting the disc at the exit position and moving the disc out of the guiding passageway;

a roller member positioned adjacent the bottom of the exit position to receive the lower edge of the disc and to support and translate the disc as it is pushed by the pushing device; and a roller unit positioned movably adjacent the exit position to provide one of a first direction and a second direction for the disc when it exists the guiding passageway.

* * * * *